US007374169B2

(12) United States Patent
Szilágyi

(10) Patent No.: US 7,374,169 B2
(45) Date of Patent: May 20, 2008

(54) TABLE BOWLING

(76) Inventor: József Szilágyi, Nádor u. 12., H-4027 Debrecen (HU)

( * ) Notice: Subject to any disclaimer, the term of this patent is extended or adjusted under 35 U.S.C. 154(b) by 100 days.

(21) Appl. No.: 10/520,614

(22) PCT Filed: Sep. 11, 2002

(86) PCT No.: PCT/HU02/00086

§ 371 (c)(1),
(2), (4) Date: Aug. 16, 2005

(87) PCT Pub. No.: WO2004/004848

PCT Pub. Date: Jan. 15, 2004

(65) Prior Publication Data

US 2006/0091601 A1 May 4, 2006

(30) Foreign Application Priority Data

Jul. 9, 2002 (HU) ..... 0202288

(51) Int. Cl.
*A63B 67/00* (2006.01)
*A63D 3/00* (2006.01)
*A63D 3/02* (2006.01)

(52) U.S. Cl. ..... 273/108; 473/107; 473/116; 273/110; 273/108.1

(58) Field of Classification Search ..... 273/108–110, 273/117, 118 R, 119 R, 129 R; 473/115–117, 473/107
See application file for complete search history.

(56) References Cited

U.S. PATENT DOCUMENTS 153,236 A * 7/1874 Butt ..... 473/107
414,986 A * 11/1889 Motter ..... 273/110
459,997 A * 9/1891 Cromwell ..... 273/108
460,431 A * 9/1891 Cromwell ..... 273/108
530,767 A * 12/1894 Griffith ..... 463/69
1,215,033 A * 2/1917 King ..... 273/110
1,502,365 A * 7/1924 Wilson ..... 273/110
2,048,915 A * 7/1936 Bayer ..... 273/129 R
2,247,769 A * 7/1941 Constant ..... 473/116
2,390,458 A * 12/1945 Pedersen ..... 273/110
3,429,573 A 2/1969 Cederberg
3,756,598 A * 9/1973 Maeda ..... 473/107
3,857,562 A * 12/1974 Rardon et al. ..... 473/107
3,863,925 A * 2/1975 Torgow ..... 273/110
3,931,972 A * 1/1976 Fabian ..... 273/110
3,934,880 A 1/1976 Laszlo
4,783,352 A * 11/1988 Kaiser, Jr. ..... 428/31
5,071,127 A * 12/1991 Bromley et al. ..... 273/108.1

(Continued)

FOREIGN PATENT DOCUMENTS

DE 9 816 5/1880

(Continued)

*Primary Examiner*—Sebastiano Passaniti
(74) *Attorney, Agent, or Firm*—Hahn & Voight PLLC

(57) ABSTRACT

A table parlour game particularly a turbo-bowling comprising a turbo player unit (1), bowling pins (2) and a lane plate tilting to any direction (3). The turbo player unit (1) is a whirling top, namely a conical solid of rotation, the plate (1/*a*) of which is shaped to have a regular hexagonal pattern and furthermore equipped with a rotating tail (1/*b*) and tip (1/*c*) and the lane plate (3) is equipped by setting device (4) comprising centrally attached globe head (4/*a*) and globe shell (4/*b*).

10 Claims, 5 Drawing Sheets

U.S. PATENT DOCUMENTS

| | | | | |
|---|---|---|---|---|
| 5,096,192 | A * | 3/1992 | Stanford, Jr. | 473/109 |
| 5,655,768 | A * | 8/1997 | Moret et al. | 273/108.5 |
| 5,785,313 | A * | 7/1998 | Shiraishi | 273/108.1 |
| 6,634,954 | B1 * | 10/2003 | Diaw | 473/116 |

FOREIGN PATENT DOCUMENTS

| | | |
|---|---|---|
| FR | 1 241 430 | 9/1960 |

* cited by examiner

TABLE BOWLING

The subject of the invention is a table parlour game particularly a turbo-bowling having a turbo player device, a lane plate tilting to any direction and bowling pins placed on the lane plate. The turbo-bowling is a table parlour game aimed even for competitions in which the players seek to obtain as much bowling pins as possible for winning through their competitors.

The turbo-bowling is a possible adaptation of the original bowling game in bench scale. In bench scale the bowling pin is done not by a bowling ball but by a whirling top fashioned in a proper way. By introducing the whirling top the original quite long lane can be a shorter one by means of the whirling top having a lower rate of travel relative to the ball. Due to this fact the size of the lane can be reduced as much as is needed to obtain the bench scale design. The direction of the whirling top is carried out by tilting the lane plate to any direction.

The whirling top substituting the bowling ball has a special shape and design in order to knock down the pins in a very efficient way. The shape of the lane plate is rectangular. The form of pins is similar to the pins being in the original bowling game.

Detailed description of the invention is presented by the following figures.

Figure 1:
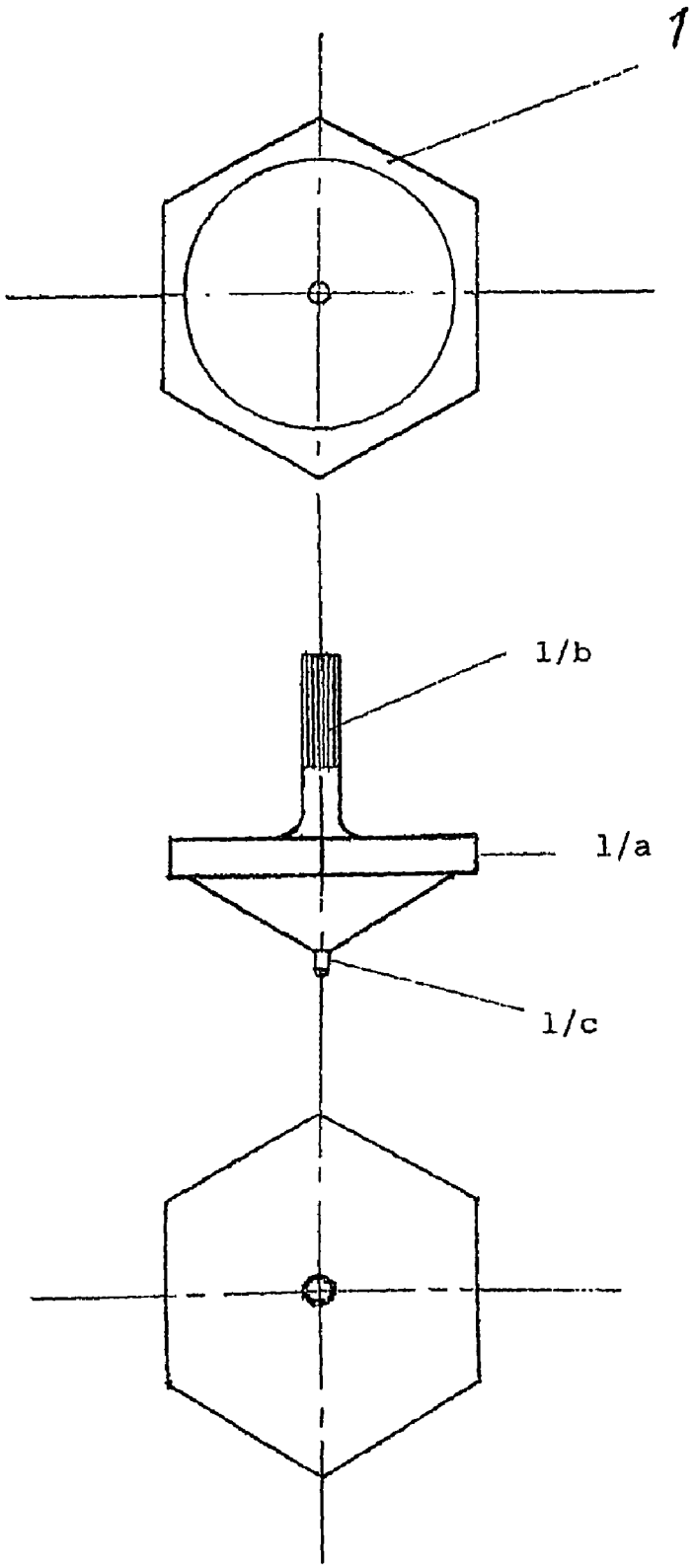

FIG. 1: bottom view, side view and top view of whirling top 1

Figure 2:
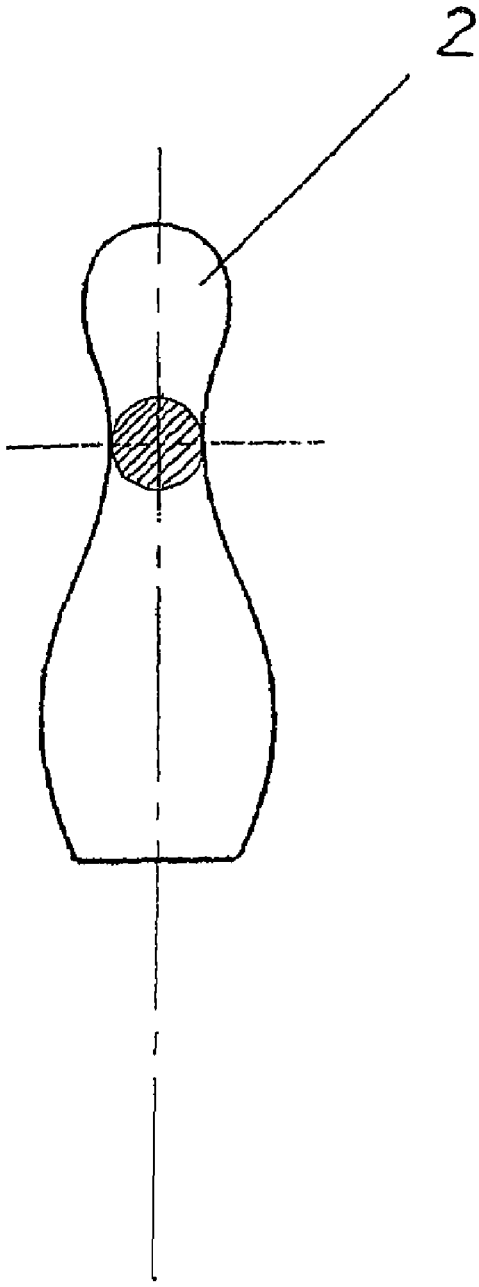

FIG. 2: view of pin 2 with its cross-section

Figure 3:
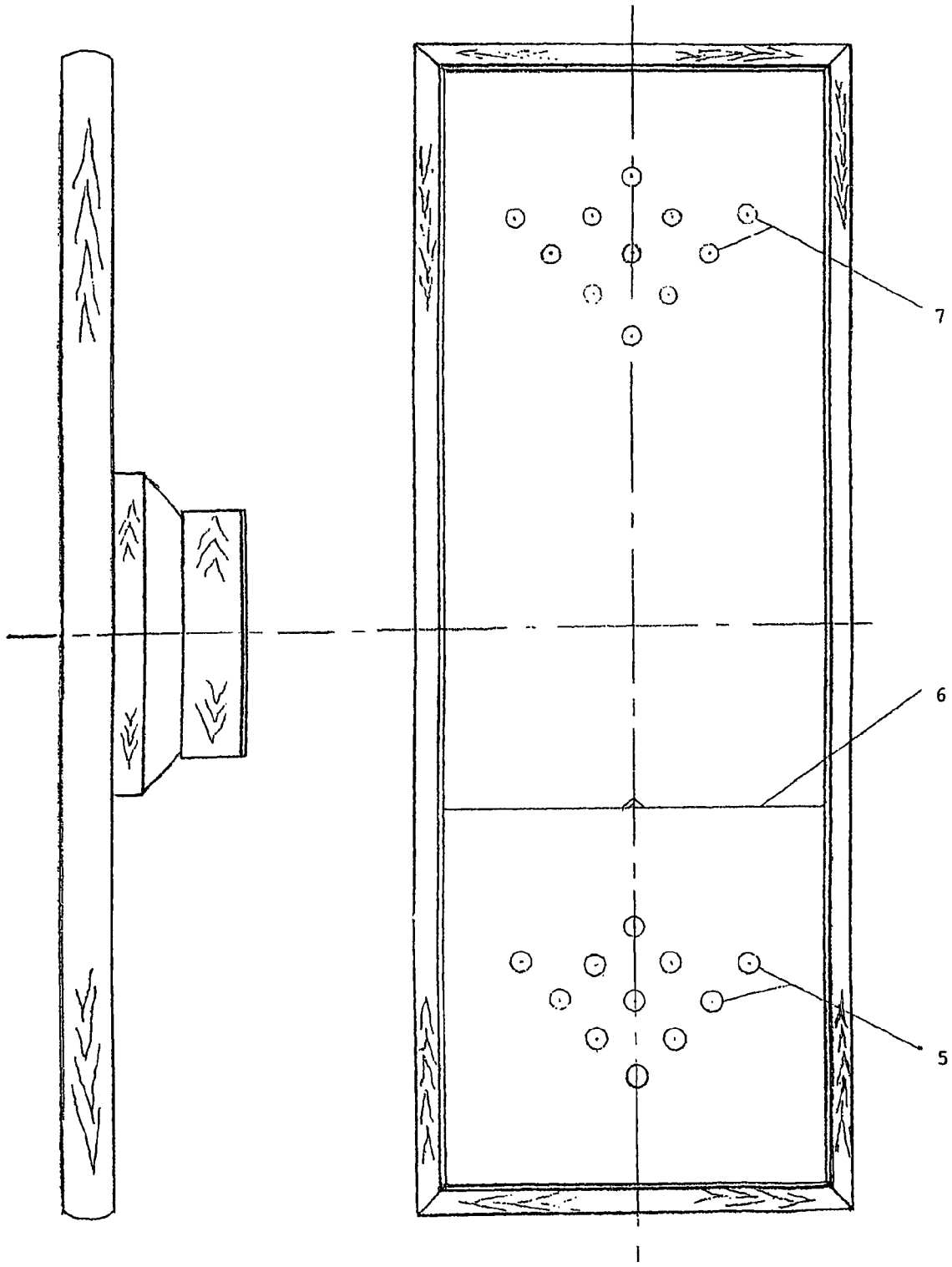

FIG. 3: top view and side view of lane plate 3

Figure 4:
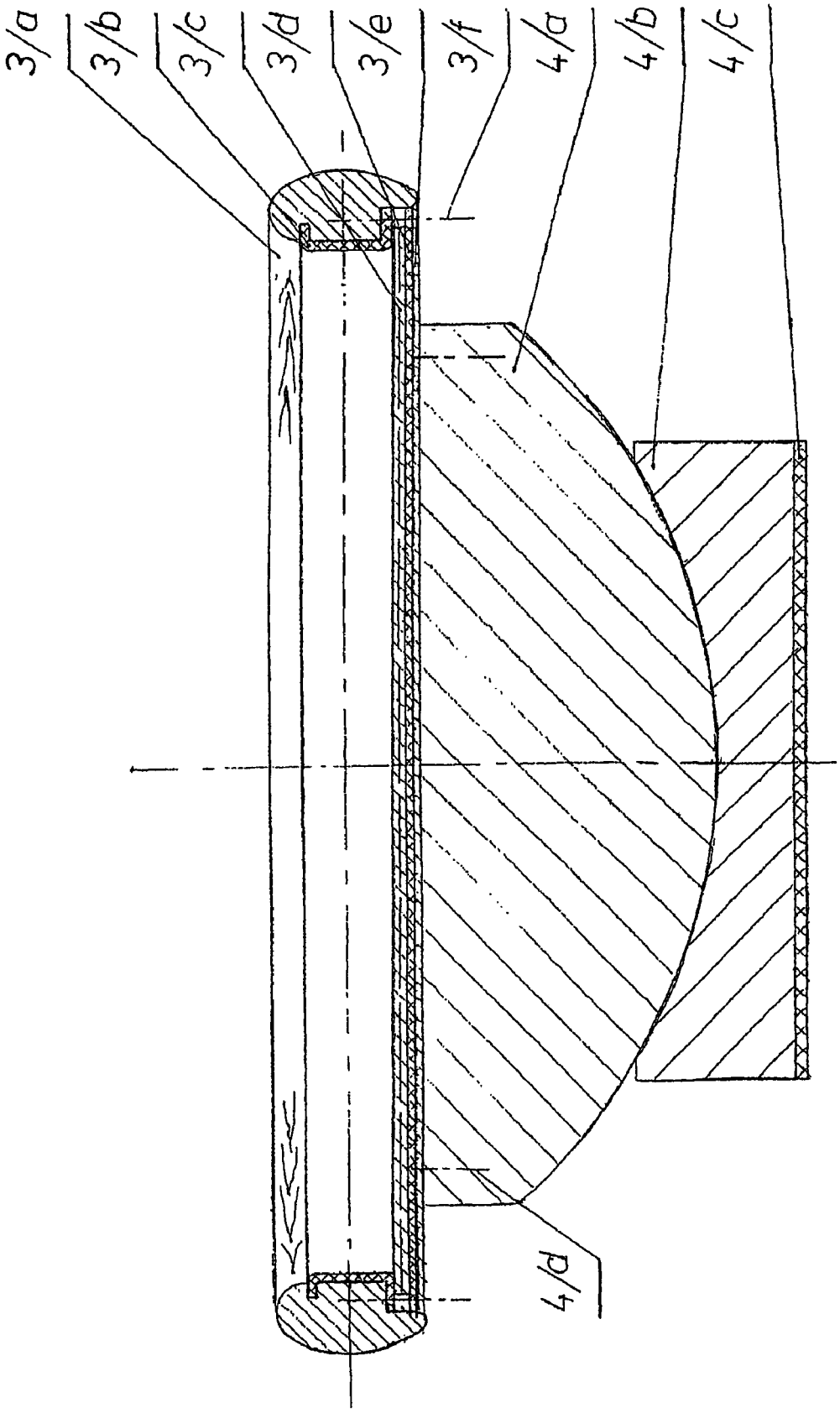
Figure 5:
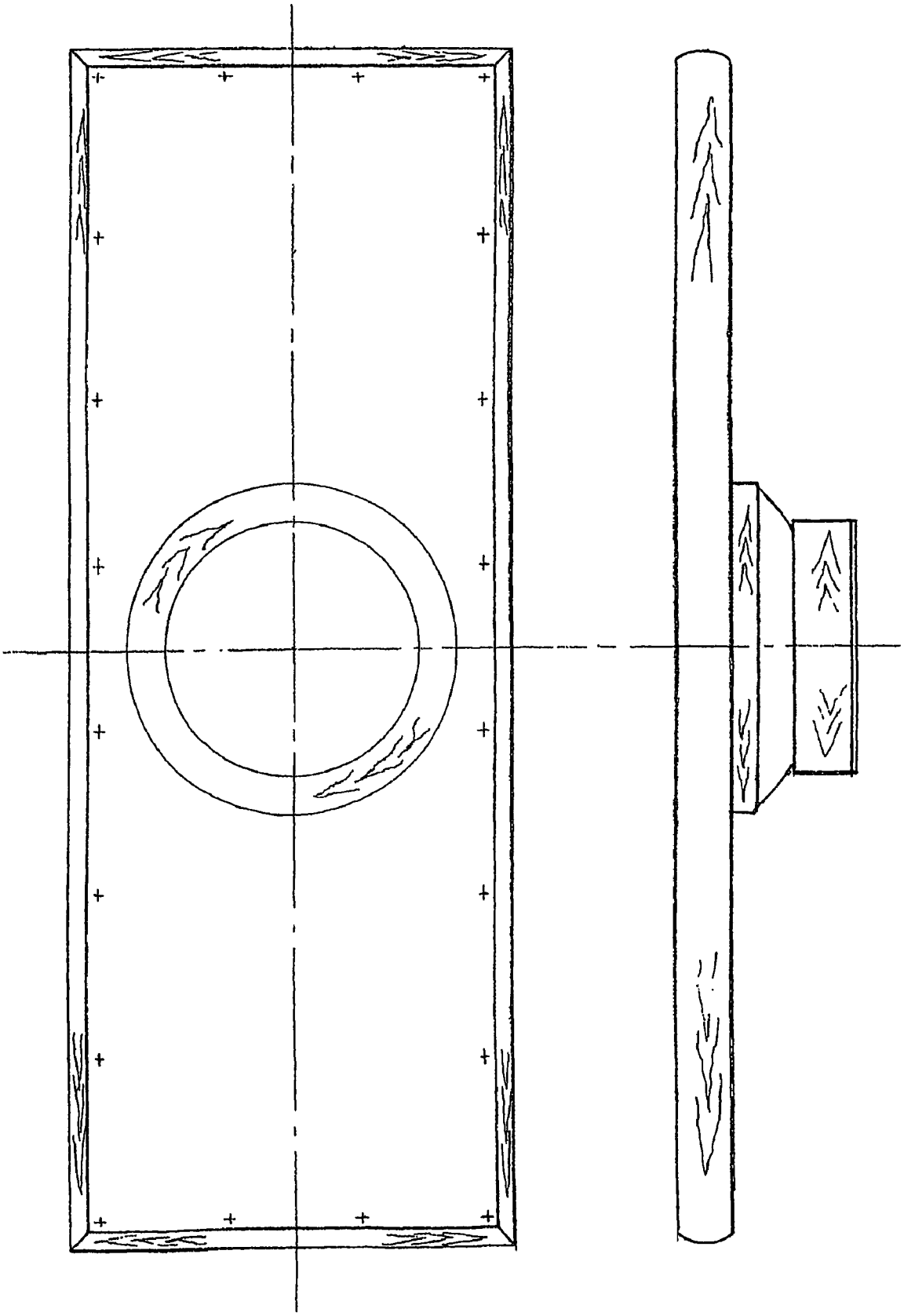

FIG. 4: cross sections of lane plate 3 and setting device 4 mounted on lane plate FIG. 5: bottom view and side view of lane plate 3 and setting device 4 mounted on lane plate 3

The major elements of turbo-bowling is the whirling top 1, pins 2, lane plate 3 and setting device 4.

The whirling top 1 is a playing device for knocking down the pins 2. The whirling top 1 is a conical rotationally symmetric solid the plate 1/*a* of which is shaped to have a regular hexagonal pattern and furthermore equipped with a rotating tail 1/*b* and tip 1/*c*.

The rotating tail 1/*b* is fashioned with grooved roughening in order to avoid slipping during twirling it by index-finger and thumb.

The conical part of whirling top 1 is ended in a cylindrical tip 1/*c*, the rotating surface of which is designed to be a semispherical head.

The design of the whirling top 1 is very important from the playing performance point of view, namely knocking down the pins 2 the fastest and most efficient way is very important.

Most preferably the shaft length of whirling top 1 is equal to the plate distance of the regular hexagon and the points' distance of regular hexagon is double of the largest diameter of pin 2.

It is also preferable if the tip 1/*c* size, namely the combined length of cylindrical part and semispherical head is double of the diameter of the cylindrical part.

For the sake of the successful game, beside the sizing the selection of the constructional material of the whirling top is very important too. Preferably the constructional material of whirling top is homogeneous brass. Due to its mass and hardness the whirling top 1 made of brass by means of a sufficient manual energy transfer is able to conduct a rotary advanced movement for a sufficiently long time on the surface of lane plate 3 positioned angularly in an adequate angle and is able to knock down the pins 2 in case of advancing towards the optimal direction. According to a preferable embodiment of the game the mass of whirling top is 100 g±5 g.

By utilising the combined mechanical energies directly or indirectly the whirling top 1 knocks down the pins 2. The combination and effectiveness of mechanical energies are guaranteed the most preferably manner by playing devices and constructional materials designed in accordance with the considerations discussed in the present invention.

Pins 2 are also revolution solids the form of which is similar to pins being in the original bowling game. The size of pins 2 basically fits to the size of lane plate 3. The constructional material and mass of pins 2 are also critical. Preferably the constructional material of pins 2 is surface-treated and air-dried lime-wood. Preferably the mass of a pin is one tenth of the mass of a whirling top 1. Proper rate of masses of pins 2 and whirling top 1 guarantees the successful game. According to a preferable embodiment of the invention the largest diameter of pin 2 is the half of the points' distance of the regular hexagonal plate 1/*a* of whirling top 1 and its mass is 10 g±1 g.

The ideal masses of whirling top 1 and pins 2 are determined eventually by the size of lane plate 3 however their relative masses are also important.

A set of pins consists of 10 pieces, consequently both ninepins and bowling with ten pins can be played.

The shape of the lane plate 3 is rectangular. According to a preferable embodiment of the invention the lane plate 3 consists of framework 3/*a*, lane plate 3/*c* and lane board 3/*e*.

The framework 3/*a* is fashioned from a revolution solid having an appropriate diameter for fitting to an ordinary human palm. Its size fits to lane plate 3/*c*. The constructional material of framework 3/*a* is preferably surface-treated and air-dried pine-wood.

Optionally the internal side of framework 3/*a* is protected by a rubber strip 3/*b*. The rubber strip 3/*b* has a double function: on the one hand it protects the surface damage of framework 3/*a* caused by the whirling top 1 and on the other side it provides the recognition of a false twirl.

The lane plate 3/*c* is an important element of play-field the hard and plane surface of which supports the complex movement of whirling top 1. Selection of its constructional material should be done by taking into consideration of these criteria. The lane plate 3/*c* may be made of laminated shatterproof glass, rigid and transparent plastic, or hardwood, etc.

According to a preferable embodiment of the invention the lane plate 3/*c* is made of laminated shatterproof glass. As an advantage the transparent glass plane provides the visibility of field symbols, i.e. white starting cycles against a green background, starting-line and pin-stands, furthermore it is scratch resistance for prolonged application. In case of ninepin or bowling game the size of lane plate 3/*c* should be adjusted in such a way the length of rectangle to be three times of its width.

The field symbols of the lane may be drawn directly on the lane plate 3/*c*. However due to practical reasons, e.g. for avoiding the scratching of symbols in case of a lane plate 3/*c* made of shatterproof glass the symbols are preferably placed on the lane board 3/*d* positioned below the lane plate 3/*c*. Its constructional material is preferably plastic foil bonded to a cardboard.

From bottom side the lane plate 3 is closed by clamping-plate 3/*e* fastened by holding screws 3/*f* to framework 3/*a* The clamping-plate 3/*e* has a double function fastening the board 3/*d* with lane plate 3/*c* and the setting device 4 to the framework. Preferably the plate is made of stainless steel and its size fits to the bottom part of framework 3/*a*.

In case of the bench scale version beside whirling top 1 an other important new design is the tilting lane plate being on the surface of a ball used for the rotating whirling top 1 to advance forward and aside under a favourable twirling and lane plate tilting conditions towards the pins.

Aim of the setting device 4 is to fulfil this demand by its construction designed as a revolution solid consisting of two elements namely globe head 4/*a* and globe shell 4/*b*. The size of globe head 4/*a* is designed in a manner that by seating in globe shell 4/*b* it can provide any arbitrary setting positions of lane plate 3.

The globe head 4/*a* of setting device 4 is attached centrally to plate 3/*e* and mounted by means of a clamping screw 4/*d* to plate 3/*e*.

The adhesion of rasping surfaces of globe head 4/*a* and globe shell 4/*b* can be achieved by lithographic chalking. The design and the fashioning of setting device 4 is prepared for holding the lane plate 3 after its tilting and setting in a given position until the next setting.

For avoiding the deformation and cracking the constructional material of setting device 4 is preferably air-dried laminated pine-wood and the cylindrical parts of both elements are surface-treated.

The material quality and the fashioning of setting device 4 together with the auxiliary material (lithographic chalk) used for providing adhesion ensures the adjustment of lane plate 3.

An anti-skidding rubber slab 4/*c* is bonded to the bottom surface of the globe shell 4/*b* for avoiding the motion on a plain surface, e.g. on a table under operation.

Total mass of a preferable embodiment of the game is around 16 kg.

Both the traditional ninepins and bowling with ten pins can be played with the turbo-bowling.

The field symbols i.e. the starting cycles 5, starting-line 6 and pin-stands 7 are marked on FIG. 3. Player is behind the starting cycles 5.

The twirling of whirling top 1 should be done inside the starting cycle 5 providing that during operation the tip 1/*c* of whirling top 1 remains inside the starting cycle 5. The starting cycles 5 represent different scales of difficulties.

The designation of starting-line 6: whirling top 1 twirled in starting cycle 5 should be directed by means of tilting the lane plate 3 for achieving till the starting line 6 the expected best direction of whirling top departed from starting cycle 5. Until tip 1/*c* overpasses the starting line 6 the player may does modification by tilting the lane plate 3. During tilting the pins 2 are not allowed to be tumbled. The starting line 6 is located in the first third section of lane plate 3.

The pin-stands 7 mean the place of pins. Pin-stands 7 are located in the last third section of play-field. The pins should be placed on the circles of play-stands 7.

The arrangement of starting cycles 5 and pin-stands 7 on lane plate 3 are identical and symmetrical relative to the longitudinal axis of lane plate 3. The centres of neighbouring starting cycles 5 and pin-stands 7 are in equal distance from each other.

In the game on the surface of lane plate 3 placed into horizontal position after the whirling top 1 actuation twirled manually such a spinning can be initiated by means of tilting the lane plate 3 that most of the pins 2 can be tumbled. The whirling top 1 is able to tumble pins 2 directly or indirectly. During spinning the regular hexagonal plate 1/*a* of whirling top 1 tumbles the pins 2 in a spectacular manner, naturally in case of a successful score(s). The pins 2 remained in standing position but slipped out of the starting cycles 5 should be set back to their original place.

Twirling can be carried out by both hands however it might happen that somebody can do both twirls by one hand.

Condition of the successful game is to gain experiences in twirling and positioning the lane done in this order, otherwise in case of doing the lane tilting at first the whirling top slips on the lane which method will result in an invalid twirling.

Direction of lane tilting is always in opposite to the circulation direction of the whirling top.

Similar to the original bowling game both right-hand and left-hand players can play the turbo-bowling.

The game inspires for competition and it is a sportsman-like game practised alone and in team.

The game builds upon ability and combination and it is not a gambling. From pedagogical point of view it does not inspire for aggression.

The game is recommended to be taught or play from pupillage.

LIST OF REFERRED SYMBOLS

1 turbo player unit (whirling top)
1/*a* plate
1/*b* rotating tail
1/*c* tip
2 bowling pin
3 lane plate
3/*a* framework
3/*b* rubber sheet
3/*c* lane plate
3/*d* lane board
3/*e* clamping-plate
3/*f* holding screw
4 setting device
4/*a* globe head
4/*b* globe shell
4/*c* anti-skidding rubber slab
4/*d* clamping screw
5 starting cycles
6 starting-line
7 pin-stands

The invention claimed is:

1. A table parlor game comprising a turbo player unit (1), bowling pins (2) and a lane plate tilting to any direction (3), wherein the turbo player unit (1) is a whirling top, wherein the whirling top is conical and solid and comprises a plate (1/*a*) which has a regular hexagonal shape, and a rotating tail (1/*b*) and tip (1/*c*), wherein the lane plate (3) is equipped with a setting device (4) comprising a centrally attached globe head (4/*a*) and a globe shell (4/*b*), and wherein the setting device is designed and fashioned to hold the lane plate in a constant position after its tilting and setting due to adhesion between the surfaces of the globe head and globe shell.

2. The table parlor game of claim 1 wherein an anti-skidding rubber slab (4/*c*) is bonded to the bottom surface of the globe shell (4/*b*).

3. The table parlor game of claim 1, wherein the whirling top is made of homogeneous brass, and the mass of the whirling top is from 95 to 105 g.

4. The table parlor game of claim 1, wherein the pins are made of surface-treated and air-dried lime wood, and the mass of each pin is 9 to 11 g.

5. The table parlor game of claim 1, wherein the lane plate comprises laminated shatterproof transparent glass.

6. The table parlor game of claim 1, wherein adhesion of the rasping surfaces of the globe head and globe shell is achieved by lithographic chalking.

7. The table parlor game of claim 1 wherein the shape of the lane plate (3) is rectangular.

8. The table parlor game of claim 7 wherein the length of the lane plate (3) is three times its width.

9. The table parlor game of claim 7 wherein the lane plate has a plurality of starting cycles (5) where the turbo player unit is twirled and a plurality of pin-stands (7) where the pins are located, and wherein the arrangements of starting cycles (5) and pin-stands (7) are identical and the longitudinal axis of lane plate (3) is symmetrical, furthermore the middle points of the neighboring stalling cycles (5) and the middle points of the pin-stands (7) are in equal distance from each other.

10. The table parlor game of claim 7 having a starting line (6) located in a first third section of lane plate (3).

* * * * *